US006277050B1

(12) United States Patent
Nakagawa et al.

(10) Patent No.: US 6,277,050 B1
(45) Date of Patent: Aug. 21, 2001

(54) ENGINE SPEED CONTROL SYSTEM FOR WORK VEHICLE

(75) Inventors: Tomohiro Nakagawa, Hirakata; Toshikazu Okada, Osaka, both of (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/515,525

(22) Filed: Feb. 29, 2000

(30) Foreign Application Priority Data

Mar. 1, 1999 (JP) ..... 11-052729

(51) Int. Cl.[7] ..... F02D 29/04
(52) U.S. Cl. ..... 477/112
(58) Field of Search ..... 477/111, 112

(56) References Cited

FOREIGN PATENT DOCUMENTS

| | | |
|---|---|---|
| 56-141402 | 11/1981 | (JP) . |
| 57-124036 | 8/1982 | (JP) . |
| 58-103926 | 7/1983 | (JP) . |
| 58-109534 | 7/1983 | (JP) . |
| 61-34327 | 2/1986 | (JP) . |
| 61-142338 | 6/1986 | (JP) . |
| 63-42844 | 3/1988 | (JP) . |
| 5-10165 | 1/1993 | (JP) . |
| 9-4481 | 1/1997 | (JP) . |
| 10103018 * | 4/1998 | (JP) . |

* cited by examiner

*Primary Examiner*—Dirk Wright
(74) *Attorney, Agent, or Firm*—Armstrong, Westerman, Hattori, McLeland & Naughton, LLP.

(57) ABSTRACT

There is provided an engine speed control system for a work vehicle which is designed to reduce engine noise and suppress fuel consumption during vehicle suspension, the control system being capable of reducing possible instantaneous impact load caused by gear shift clutch engagement when the work vehicle resumes operation after suspension. If it is determined the state of the vehicle is changed from a work-loaded condition to a non-loaded condition, the engine speed of the vehicle is decreased to a first specified engine speed and after the first specified engine speed is maintained for a first specified period of time, the engine speed is further decreased to a second specified engine speed. In addition, if it is determined the vehicle has restored its work-loaded condition while the first or second specified engine speed being maintained, the limitation of the engine speed to the first or second specified engine speed is cancelled after an elapse of a second specified period of time after the determination.

9 Claims, 6 Drawing Sheets

ENGINE SPEED
(H/I)2150
2000
(L/I)650
B
D
E
t
1sec
3~5sec

OPERATION LEVER
F
N
R
A
G
H
1sec
t

TRANSMISSION OUTPUT
(100%)
0
C
t

ENGINE SPEED
(H/I)2150
2000
(L/I)650
B'
D'
E'
0.5sec
1sec
3~5sec
t

OPERATION LEVER
F
N
R
A'
G'
H'
1sec
t

TRANSMISSION OUTPUT
(100%)
0
C'
0.5sec
t

ENGINE SPEED CONTROL SYSTEM FOR WORK VEHICLE

TECHNICAL FIELD

The present invention relates to an engine speed control system for a work vehicle such as a bulldozer.

BACKGROUND ART

Generally, excavating and earth moving operation by use of a work vehicle such as a bulldozer is often carried out with the vehicle engine being in full operation. In such operation, when the drive of the vehicle is switched from a forward speed range to a reverse speed range or vice versa, or when the operation of the vehicle is suspended for a while with the engine running, fully operated engine generates extremely high noise and causes high fuel consumption. To cope with such situations, the operator depresses the decelerator pedal or turns the fuel throttle dial to its low idle side, thereby reducing engine speed. However, if the operator depresses the decelerator pedal or turns the fuel throttle dial in every vehicle suspension, it will impose serious burden on the operator.

To solve this problem, there have been proposed various techniques for reducing engine speed by actuating an automatic decelerator when work implement levers are brought into their neutral position to stop the work implements.

For instance, Japanese Patent Publication (KOKOKU) Gazette No. 5-52411 (1993) discloses a technique wherein engine speed is slightly reduced by actuating the automatic decelerator for a short time, upon placement of all the work implement levers in their respective neutral positions and after the engine is maintained at this reduced speed for a specified time, the automatic decelerator is again operated to further reduce engine speed. Another technique is disclosed in Japanese Patent Publication (KOKOKU) Gazette No. 60-38561 (1985) according to which, when a low speed drive control command has been issued, a low engine speed drive is instructed after an elapse of a predetermined delay time after all the operation levers are placed in their neutral positions, and measurement of the delay time is cleared at the time when at least one of the operation levers is actuated before an elapse of the delay time. Japanese Patent Publication (KOKOKU) Gazette No. 61-34327 (1986) discloses a system which is arranged such that a supply of fuel to the internal combustion engine is stopped provided that the running condition of the internal combustion engine meets a specified level, and if the gear position of the transmission is changed from its neutral position to a non-neutral position, an interruption in fuel supply will be inhibited to prevent engine stall.

The conventional techniques disclosed in these publications, however, suffer from the problem that when operation is resumed after suspension with the engine running at a reduced speed and engine speed is restored to an initial speed, occurrence of an instantaneous impact load is unavoidable at the time of engagement of the gear shift clutch of the transmission.

The present invention is directed to overcoming the foregoing problems and the prime object of the invention is, therefore, to provide an engine speed control system for a work vehicle which reduces engine speed when operation is suspended for a while in order to reduce engine noise and suppress fuel consumption, the system enabling a reduction in a possible instantaneous impact load which would occur at the time of engagement of the gear shit clutch when operation is resumed after suspension.

DISCLOSURE OF THE INVENTION

The above object can be accomplished by an engine speed control system for a work vehicle according to a first aspect of the invention, the system comprising: lever position detecting means for detecting the position of a forward/reverse drive shift operation lever for selectively determining the forward or reverse speed range of the work vehicle, engine speed detecting means for detecting the speed of an engine, and a controller for controlling the speed of the engine to a specified value based on detection signals respectively sent from these detecting means, the controller being designed such that if the lever position detecting means determines that the forward/reverse drive shift operation lever has been shifted to a neutral position when the work vehicle was in a work-loaded condition, the speed of the engine is immediately reduced to a first specified engine speed to be limited thereto and then further reduced to a second specified engine speed to be limited thereto, after the first specified engine speed is maintained for a first specified period of time, and if the lever position detecting means determines that the forward/reverse drive shift operation lever has been shifted from the neutral position to a forward drive position or a reverse drive position while the engine being kept at the first specified engine speed or the second specified engine speed, the speed of the engine is controlled so as to cancel the limitation of the engine speed to the first or second specified engine speed after an elapse of a second specified period of time after the determination.

According to the first aspect of the invention, if it is determined that the state of the work vehicle has been changed from a work-loaded condition to a non-loaded condition by shifting the forward/reverse drive shift operation lever to its neutral position, engine speed is automatically, immediately reduced to a first specified engine speed and limited to it. If the forward/reverse drive shift operation lever is not shifted to a forward or reverse drive position even when the first specified engine speed is maintained for a time that is not less than a first specified time period, engine speed is further reduced and limited to a second specified engine speed which is lower than the first specified engine speed. In this way, not only can engine noise be reduced during vehicle suspension but also useless fuel consumption can be suppressed. If it is determined that the forward/reverse drive shift operation lever has been shifted from its neutral position to a forward or reverse drive position (that is, the operation of the vehicle has been resumed) while the engine is kept at the first or second specified engine speed, the limitation of the engine speed to the first or second specified engine speed is cancelled after an elapse of a second specified period of time after the determination. With this arrangement, when the vehicle resumes operation after suspension, the engine is able to quickly return to an engine speed which corresponds to the load of an operation to be carried out after the resumption. Further, since there is proved a delay time (i.e., the second specified period of time) for the restoration, engagement of the gear shift clutch can be completed within this delay time, which ensures that occurrence of an impact load due to clutch engagement during the restoration is prevented.

In the invention, the lever position detecting means preferably detects the position of the forward/reverse drive shift operation lever by detecting a pilot oil pressure for a transmission shifting oil pressure.

Preferably, in the invention, the first specified engine speed is set to a value (e.g., 2,000 rpm) that is slightly lower than a high idle engine speed (e.g., 2,150 rpm) while the second specified engine speed is set to a value equal to a low idle engine speed (e.g., 650 rpm).

It is preferable that the first specified period of time be set to 3 to 5 sec. and the second specified period of time be set to about 1 sec.

According to a second aspect of the invention, there is provided an engine speed control system for a work vehicle, the system comprising: lever position detecting means for detecting the position of a forward/reverse drive shift operation lever for selectively determining the forward or reverse speed range of the work vehicle, engine speed detecting means for detecting the speed of an engine, and a controller for controlling the speed of the engine to a specified value based on detection signals respectively sent from these detecting means, the controller being designed such that if the lever position detecting means determines that the forward/reverse drive shift operation lever has been shifted to a neutral position when the work vehicle was in a work-loaded condition, the speed of the engine is reduced to a first specified engine speed to be limited thereto after an elapse of a third specified period of time after the determination and then further reduced to a second specified engine speed to be limited thereto, after the first specified engine speed is maintained for a first specified period of time, and if the lever position detecting means determines that the forward/reverse drive shift operation lever has been shifted from the neutral position to a forward drive position or a reverse drive position while the engine being kept at the first specified engine speed or the second specified engine speed, the speed of the engine is controlled so as to cancel the limitation of the engine speed to the first or second specified engine speed after an elapse of a second specified period of time after the determination.

While the system according to the first aspect is designed such that engine speed is immediately reduced to the first specified engine speed upon determination that the forward/reverse drive shift operation lever has been shifted to its neutral position when the work vehicle was in its work-loaded condition, the system according to the second aspect is designed such that engine speed is reduced to the first specified engine speed after an elapse of a third specified period of time after determination of a shift to the neutral position. With this arrangement, the following effect can be achieved in addition to the effects of the first aspect: when the forward/reverse drive shift operation lever is instantaneously shifted from the forward drive position to the reverse drive position or vice versa, a useless drop in engine speed can be prevented, thereby to reduce time losses in engine speed restoration.

In the invention, the lever position detecting means preferably detects the position of the forward/reverse drive shift operation lever by detecting a pilot oil pressure for a transmission shifting oil pressure.

Preferably, in the invention, the first specified engine speed is set to a value (e.g., 2,000 rpm) that is slightly lower than a high idle engine speed (e.g., 2,150 rpm) whereas the second specified engine speed is set to a value equal to a low idle engine speed (e.g., 650 rpm).

It is preferable that the first specified period of time be set to 3 to 5 sec., the second specified period of time be set to about 1 sec., and the third specified period of time be set to about 0.5 sec.

BEST MODE FOR CARRYING OUT THE INVENTION

Referring now to the accompanying drawings, an engine speed control system for a work vehicle will be concretely described according to preferred embodiments of the invention.

(First Embodiment)

Figure 1:
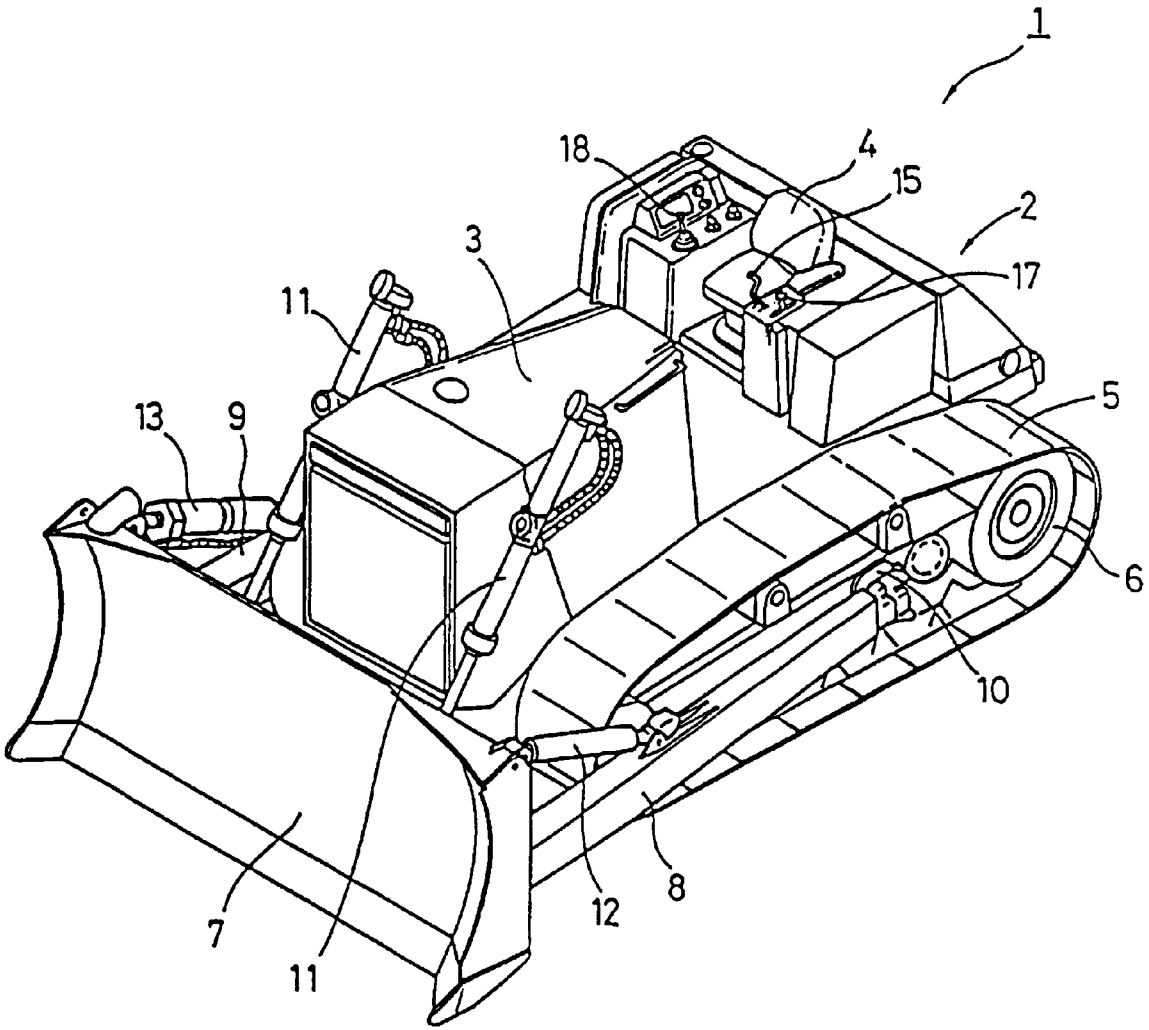
FIG. 1 shows the external appearance of a bulldozer according to a first embodiment of the invention.

Described below is an engine speed control system constructed according to a first embodiment of the invention, which is applied to a bulldozer. FIG. 1 shows the external appearance of a bulldozer 1 associated with the present embodiment.

In the bulldozer 1 of the present embodiment, there are provided a bonnet 3 and a cab 4 on a vehicle body 2. Disposed on both right and left sides of the vehicle body 2 when viewed in the forward driving direction of the vehicle body 2 are crawler belts 5 for driving the vehicle body 2 so as to travel forwardly and reversely and turn. These crawler belts 5 are respectively independently driven by driving force transmitted from an engine 19 (see FIG. 2) with the aid of their associated sprockets 6.

A blade 7 is supported at the leading ends of right and left straight frames 8, 9 the base ends of which are, in turn, pivotally supported at the right and left sides of the vehicle body 2 through trunnions 10 (the trunnion on the right side is not shown in the drawing) in such a way that the blade 7 can be raised and lowered. A pair of side-by-side blade lift cylinders 11 are arranged between the blade 7 and the vehicle body 2, for raising and lowering the blade 7. A brace 12 and a blade tilt cylinder 13 are provided for laterally tilting the blade 7. Specifically, the brace 12 is positioned between the left straight frame 8 and the blade 7 while the blade tilt cylinder 13 being positioned between the right straight frame 9 and the blade 7.

Positioned on the left side of the cab 4 are a steering operation lever 15 which also serves as a gear shift lever (forward/reverse drive shift operation lever) for forward and reverse drives and a fuel controlling lever 17, while a blade controlling lever 18 or the like being disposed on the right side for raising, lowering, left-tilting and right-tilting the blade 7. Although not shown in the drawing, there is provided a decelerator pedal in front of the cab 4.

Figure 2:
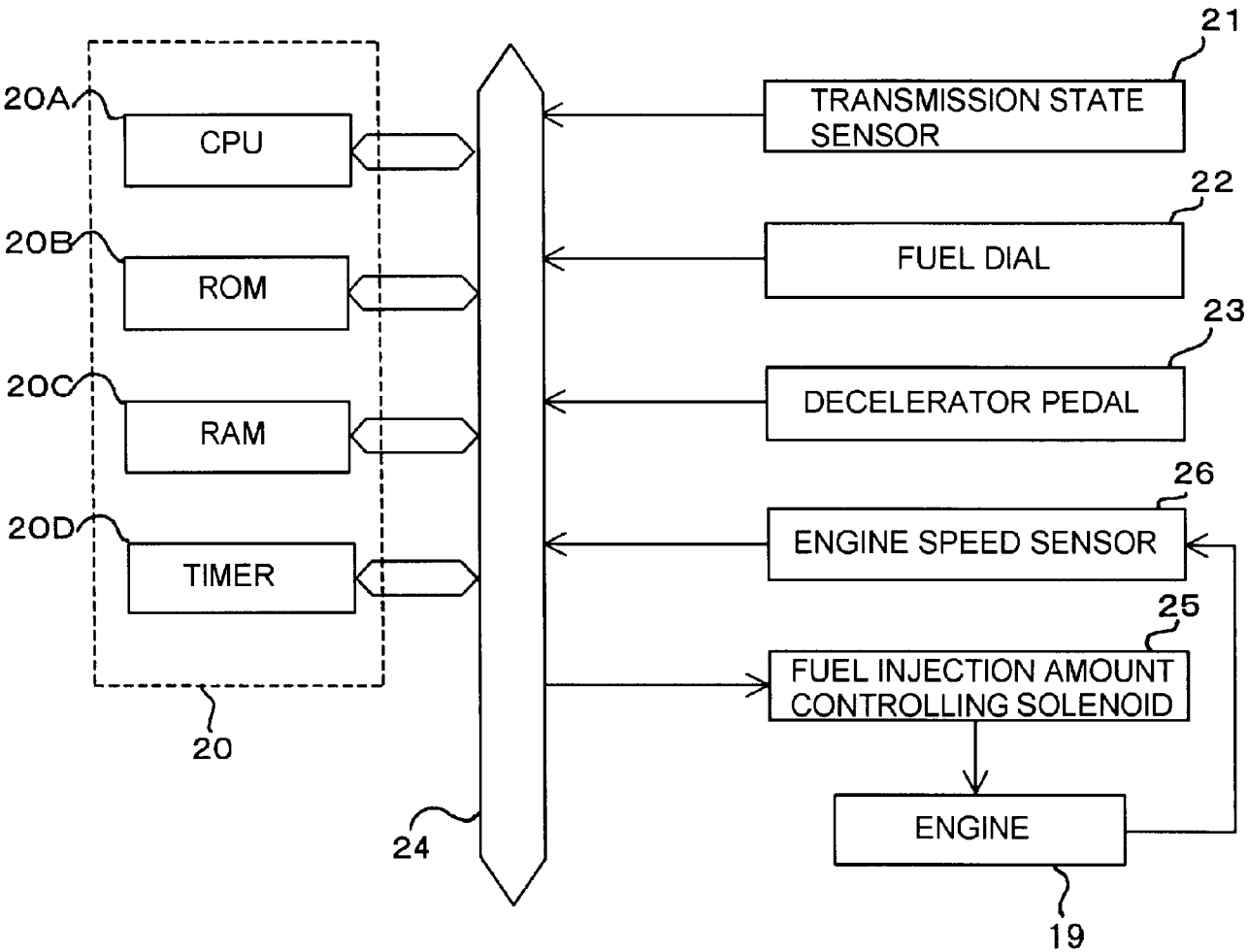
FIG. 2 is a block diagram of an engine speed control system according to the first embodiment.

FIG. 2 shows a block diagram of an engine speed control system according to the first embodiment. This system is provided with a controller 20 for controlling the engine 19 of the bulldozer 1. The controller 20 inputs a transmission-positional signal from a transmission state sensor (lever position detecting means) 21, the signal being indicative of the lever position of the steering operation lever 15, in other words, which gear range the transmission is placed in. The controller 20 also inputs a dial value signal from a fuel dial 22 for setting the amount of fuel injection and a deceleration signal from the decelerator pedal 23. These signals are input by way of a bass 24. It should be noted that in the present embodiment, the transmission state sensor 21 detects the state of the transmission by sensing a pilot oil pressure for a transmission shifting oil pressure.

The controller 20 is composed of a central processing unit (CPU) 20A for executing a specified program, a read only memory (ROM) 20B for storing this program and various maps, a random access memory (RAM) 20C which functions as a working memory and registers necessary for execution of the program, and a timer 20D for measuring elapsed time for an event in the program. The controller 20 executes the program based on signals sent from the respective sensors so that the injection amount of fuel to be supplied to the engine 19 is calculated. Based on the result of the arithmetic operation, the controller 20 outputs a signal to a fuel injection amount controlling solenoid 25. The speed of the engine 19 is detected by an engine speed sensor (engine speed detecting means) 26 which in turn feeds a detection signal back to the controller 20 whereby the engine 19 is controlled so as to be maintained at an instructed engine speed.

Figure 3:
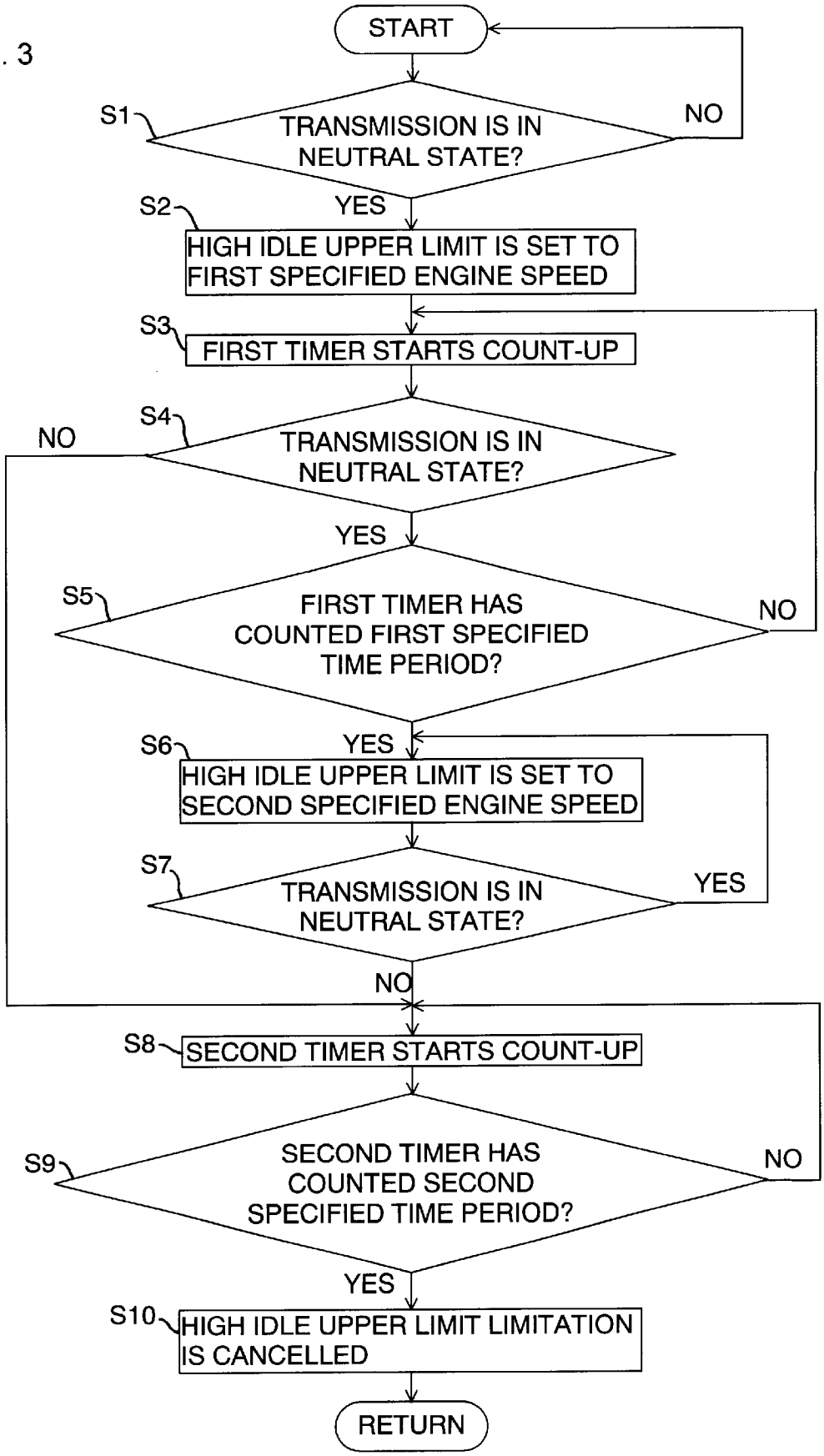
FIG. 3 is a flow chart of a control flow according to the first embodiment.
Figure 4:
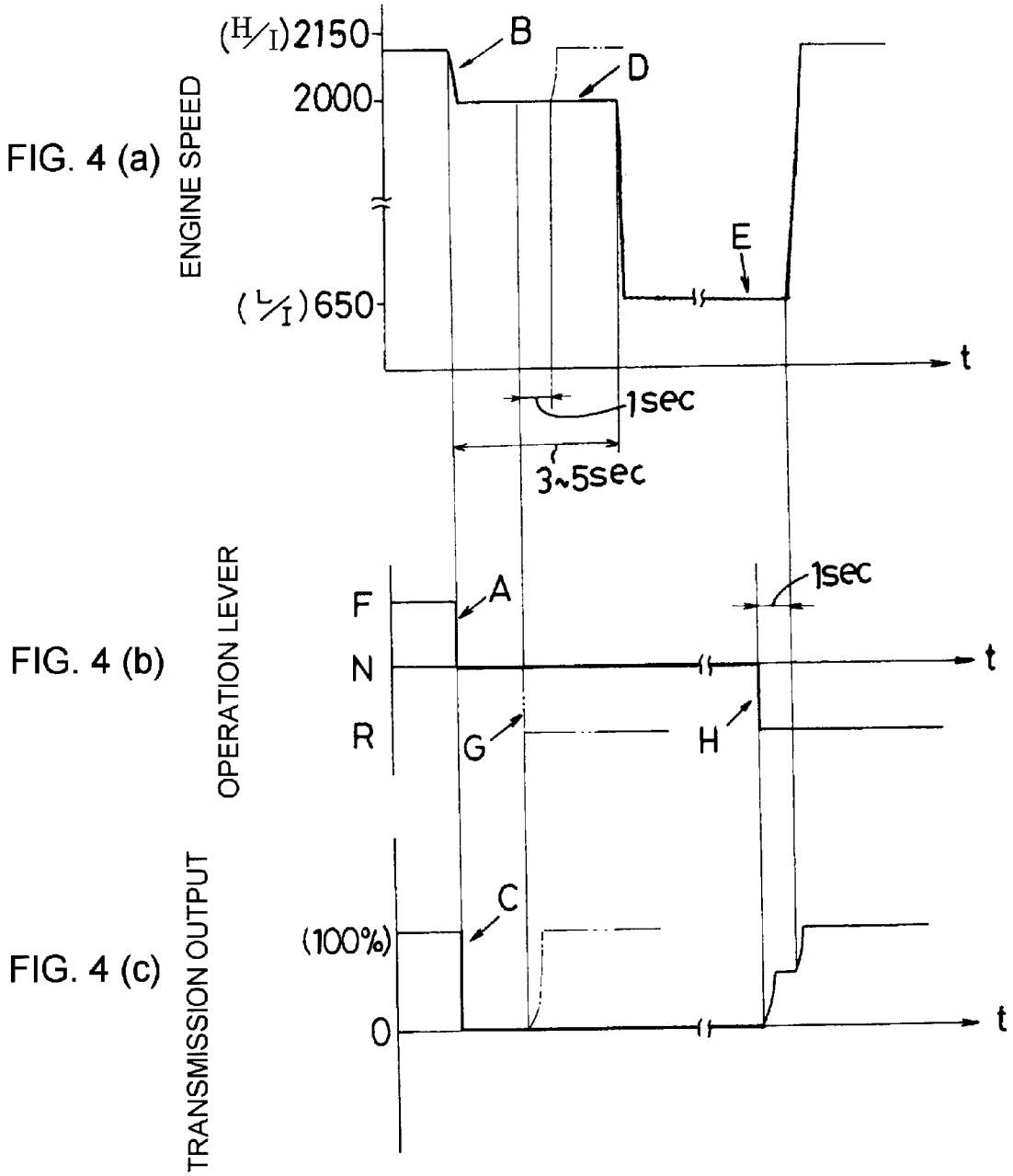
FIG. 4 is a time chart of the control according to the first embodiment.

A control flow for the engine speed control of the present embodiment will be described, referring to the flow chart of FIG. 3 in conjunction with the time chart of FIG. 4.

Step S1 to Step S2: A check is made to determine from a signal from the transmission state sensor 21 whether the transmission has been placed in the neutral state. If it is determined that the transmission has been placed in the neutral state, it is then judged that the engine 19 has been brought into a non-loaded state and a present engine speed is compared to a first specified engine speed (the first specified engine speed is 2,000 rpm while the high idle engine speed is 2,150 rpm in the present embodiment) stored in the ROM 20B. If the first specified engine speed is lower than the present engine speed, the first specified engine speed is set to the upper limit of the high idle engine speed. In the time chart of FIG. 4, when the steering operation lever (hereinafter simply referred to as "operation lever") 15 is shifted from the forward drive position (F) to the neutral position (N) as indicated by arrow A in FIG. 4(*b*), engine speed is decreased to 2,000 rpm from the value before the shift of the transmission to the neutral position (N), as indicated by arrow B in FIG. 4(*a*). At the same time, the gear shift clutch is disengaged to decrease the output of the transmission from 100% to 0%, as indicated by arrow C in FIG. 4(*c*).

Step S3: The high idle upper limit is set to the first specified engine speed and at the same time, a first timer in the timer 20D starts count-up.

Step S4 to Step S6: A check is made again to determine whether the transmission is in its neutral state, and if so, the first specified engine speed is maintained as indicated by arrow D in FIG. 4(*a*) until the first timer has counted a preset, first specified time period (=3 to 5 sec. in the present embodiment). After the first specified time period has elapsed, the high idle upper limit of engine speed is decreased to a second specified engine speed (=650 rpm which is a low idle engine speed in the present embodiment) stored in the ROM 20B, as indicated by arrow E in FIG. 4(*a*).

Step S7: A check is made again to determine whether the transmission is in its neutral state, and if so, the limitation of the high idle upper limit to the second specified engine speed is maintained. On the other hand, if it is determined the transmission has been shifted from its neutral state to the reverse (R) or forward (F) drive state by shifting the operation lever 15 as indicated by arrow H in FIG. 4(*b*), the program proceeds to the next step S8. If the transmission is shifted from its neutral state to the reverse (R) or forward (F) drive state by shifting the operation lever 15 during counting-up by the first timer (Step S3) as indicated by arrow G in FIG. 4(*b*), the program proceeds to Step S8 without performing the processes of Steps S5 to S7.

Step S8 to Step S10: At the same time when the vehicle resumes operation from its neutral state, a second timer in the timer 20D starts count-up. The second or first specified engine speed is maintained until the second timer has counted a preset, second specified time period (=about 1 sec. in the present embodiment). Just after an elapse of the second specified time period, the limitation of the high idle upper limit of engine speed is cancelled. The reason why a delay time of about 1 sec. (i.e., the second specified time period) is provided when the vehicle resumes operation after suspension is that the gear shift clutch is able to complete engagement within 1 sec. Specifically, the provision of the delay time allows the gear shift clutch to be engaged within the delay time so that engine speed can be restored subsequently to the engagement. Thus, the provision of this delay time positively prevents occurrence of a possible impact load which would be caused by clutch engagement during resumption of vehicle operation.

As has been described above, the first embodiment is designed such that when it is determined the vehicle has changed from a work-loaded state to a suspended state, engine speed is automatically reduced stepwise to the first specified engine speed and then to the second specified engine speed which is lower than the first specified engine speed and at each stage, engine speed is limited to each specified engine speed. Therefore, engine noise during vehicle suspension can be reduced and unnecessary fuel consumption can be suppressed. When vehicle operation is resumed from the state where the first or second specified engine speed is maintained, a desired engine speed is restored after an elapse of the time required for completion of engagement of the gear shift clutch, which positively prevents occurrence of a possible impact load caused by clutch engagement during resumption of vehicle operation.

(Second Embodiment)

Figure 5:
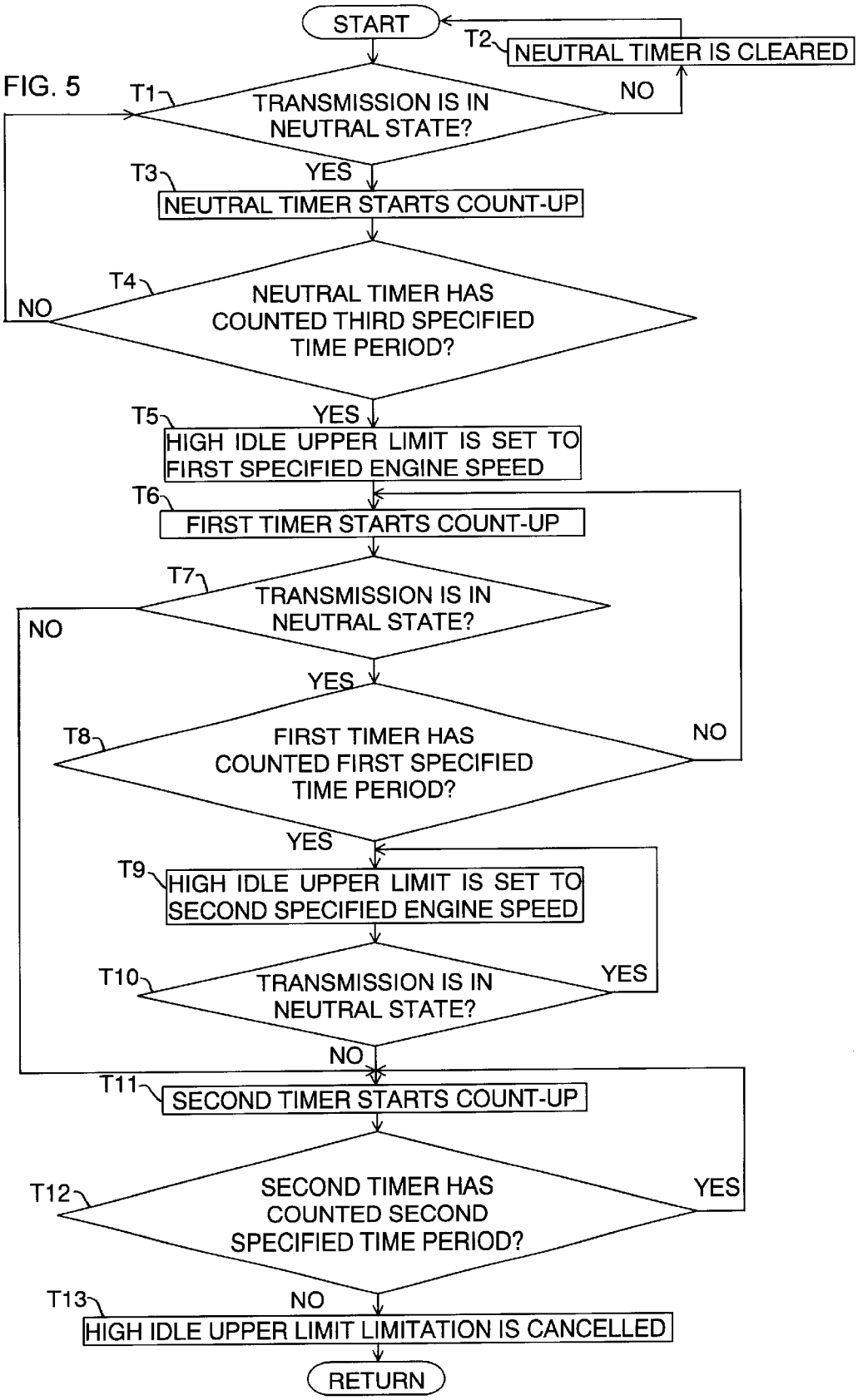
FIG. 5 is a flow chart of a control flow according to a second embodiment of the invention.
Figure 6:
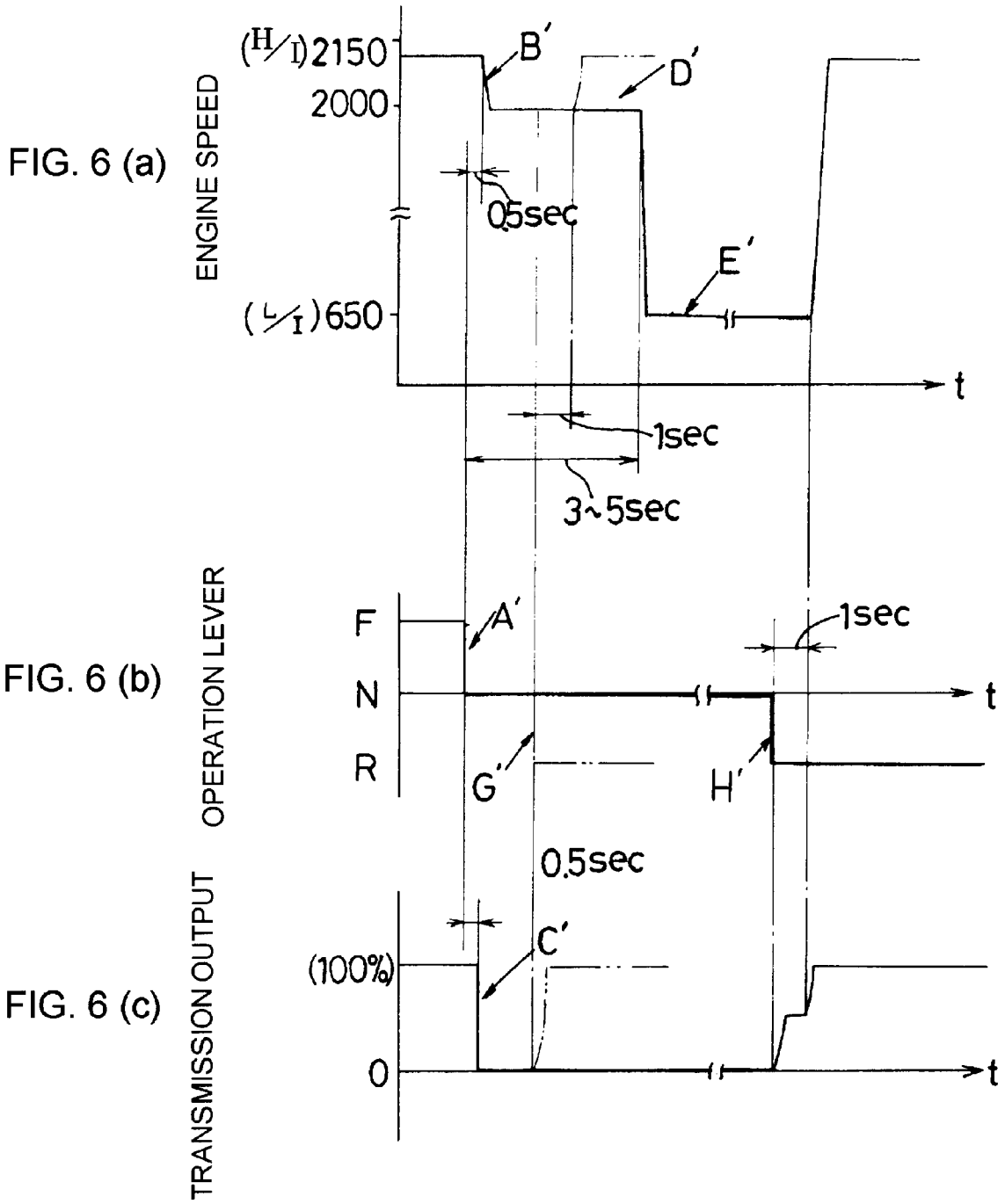
FIG. 6 is a time chart of the control according to the second embodiment.

The structures of the bulldozer and the engine speed control system to which the engine speed control of the second embodiment is applied are similar to those of the first embodiment shown in FIGS. 1 and 2. Therefore, a detailed explanation of them will be omitted from the following description. Now, the engine speed control of the second embodiment will be described below with reference to the flow chart of FIG. 5 in conjunction with the time chart of FIG. 6.

Step T1 to Step T3: A check is made to determine from a signal from the transmission state sensor 21 whether the transmission has been shifted to its neutral state. If it is determined the transmission has not been shifted to the neutral state, a neutral timer for counting the time elapsing after a shift to the neutral state is cleared. On the other hand, if it is determined the transmission has been shifted to the neutral state, it is then judged that the engine 19 has been brought into its non-loaded state so that the neutral timer starts count-up.

Step T4 to Step T5: A check is made to determine whether a third specified time period (=0.5 sec. in the present embodiment) stored in the ROM 20B has been counted by the neutral timer, and if the third specified time period has not elapsed, the program returns to Step T1. On the other hand, if the neutral timer has counted the third specified time period, the present engine speed is compared to the first specified engine speed (which is 2,000 rpm whereas the high idle engine speed is 2,150 rpm in the present embodiment)

stored in the ROM 20B. If the first specified engine speed is lower than the present engine speed, the first specified engine speed is set to the upper limit of the high idle engine speed. Referring to the time chart of FIG. 6, when the operation lever 15 is shifted from the forward drive position (F) to the neutral position (N) as indicated by arrow A' in FIG. 6(*b*), engine speed is reduced to 2,000 rpm from the value before the transmission shifting, after a third specified time period elapsed after completion of the shifting operation, as indicated by arrow B' in FIG. 6(*a*). At the same time, the gear shift clutch is disengaged thereby to reduce the output of the transmission from 100% to 0% as indicated by arrow C' in FIG. 6(*c*). The provision of the neutral timer prevents a useless drop in engine speed when instantaneously shifting the operation lever 15 from the forward drive position to the reverse drive position or vice versa, and as a result, time losses in engine speed restoration can be reduced.

Step T6: The high idle upper limit is set to the first specified engine speed, while the first timer in the timer 20D starts count-up.

Step T7 to Step T9: A check is made again to determine whether the transmission is in its neutral state. If the transmission is in its neutral state, the first specified engine speed is maintained (as indicated by arrow D' in FIG. 6(*a*)) until the first timer has counted the preset first specified time period (=3 to 5 sec. in the present embodiment), and after the first specified time period has elapsed, the high idle upper limit of engine speed is reduced (as indicated by arrow E' in FIG. 6(*a*)) to the second specified engine speed (=650 rpm (low idle engine speed) in the present embodiment) which is stored in the ROM 20B.

Step T10: A check is made again to determine whether the transmission is in its neutral state and if so, the limitation of the high idle upper limit to the second specified engine speed is maintained. On the other hand, if it is determined the operation lever 15 has been shifted from the neutral position to the reverse drive (R) or forward drive (F) position as indicated by arrow H' in FIG. 6(*b*), the program proceeds to the next step T11. It should be noted that if the operation lever 15 is shifted from the neutral position to the reverse drive(R) or forward drive (F) position (as indicated by arrow G' in FIG. 6(*b*)) during counting up by the first timer (Step T6), the program proceeds to Step T11, without performing the processes of Steps T8 to T10.

Step T11 to Step T13: At the same time when the vehicle resumes operation from its neutral state, a second timer in the timer 20D starts count-up. The second or first specified engine speed is maintained until the second timer has counted a preset, second specified time period (=about 1 sec. in the present embodiment). Just after the second specified time period has elapsed, the limitation of the high idle upper limit of engine speed is cancelled.

In addition to the effects of the first embodiment which are a reduction in engine noise and a suppression of unnecessary fuel consumption during vehicle suspension and prevention of occurrence of possible impact load caused by clutch engagement when operation is resumed, the following effect can be achieved by the second embodiment: when the operation lever 15 is instantaneously shifted from the forward drive position to the reverse drive position through the neutral position or vice versa, a useless drop in engine speed can be prevented so that time losses in engine speed restoration can be reduced.

Although the invention has been discussed in the context of a bulldozer in the foregoing embodiments, it is equally applicable to other work vehicles including hydraulic shovels.

What is claimed is:

1. An engine speed control system for a work vehicle, the system comprising: lever position detecting means for detecting the position of a forward/reverse drive shift operation lever for selectively determining the forward or reverse speed range of the work vehicle, engine speed detecting means for detecting the speed of an engine, and a controller for controlling the speed of the engine to a specified value based on detection signals respectively sent from said detecting means, the controller being designed such that if the lever position detecting means determines that the forward/reverse drive shift operation lever has been shifted to a neutral position when the work vehicle was in a work-loaded condition, the speed of the engine is immediately reduced to a first specified engine speed to be limited thereto and then further reduced to a second specified engine speed to be limited thereto after the first specified engine speed is maintained for a first specified period of time, and if the lever position detecting means determines that the forward/reverse drive shift operation lever has been shifted from the neutral position to a forward drive position or a reverse drive position while the engine being kept at the first specified engine speed or the second specified engine speed, the speed of the engine is controlled so as to cancel the limitation of the engine speed to the first or second specified engine speed after an elapse of a second specified period of time after the determination.

2. An engine speed control system for a work vehicle according to claim 1, wherein the lever position detecting means detects the position of the forward/reverse drive shift operation lever by detecting a pilot oil pressure for a transmission shifting oil pressure.

3. An engine speed control system for a work vehicle according to claim 1 or 2, wherein the first specified engine speed is set to a value that is slightly lower than a high idle engine speed whereas the second specified engine speed is set to a value equal to a low idle engine speed.

4. An engine speed control system for a work vehicle according to claim 1 or 2, wherein the first specified period of time is set to 3 to 5 sec., whereas the second specified period of time is set to about 1 sec.

5. An engine speed control system for a work vehicle, the system comprising: lever position detecting means for detecting the position of a forward/reverse drive shift operation lever for selectively determining the forward or reverse speed range of the work vehicle, engine speed detecting means for detecting the speed of an engine, and a controller for controlling the speed of the engine to a specified value based on detection signals respectively sent from said detecting means, the controller being designed such that if the lever position detecting means determines that the forward/reverse drive shift operation lever has been shifted to a neutral position when the work vehicle was in a work-loaded condition, the speed of the engine is reduced to a first specified engine speed to be limited thereto after an elapse of a third specified period of time after the determination and then further reduced to a second specified engine speed to be limited thereto, after the first specified engine speed is maintained for a first specified period of time, and if the lever position detecting means determines that the forward/reverse drive shift operation lever has been shifted from the neutral position to a forward drive position or a reverse drive position while the engine being kept at the first specified engine speed or the second specified engine speed, the speed of the engine is controlled so as to cancel the limitation of the engine speed to the first or second specified engine speed after an elapse of a second specified period of time after the determination.

6. An engine speed control system for a work vehicle according to claim 5, wherein the lever position detecting means detects the position of the forward/reverse drive shift operation lever by detecting a pilot oil pressure for a transmission shifting oil pressure.

7. An engine speed control system for a work vehicle according to claim 5, wherein the first specified engine speed is set to a value that is slightly lower than a high idle engine speed whereas the second specified engine speed is set to a value equal to a low idle engine speed.

8. An engine speed control system for a work vehicle according to claim 6 or 7, wherein the first specified period of time is set to 3 to 5 sec., the second specified period of time is set to about 1 sec., and the third specified period of time is set to about 0.5 sec.

9. An engine speed control system for a work vehicle according to claim 6, wherein the first specified engine speed is set to a value that is slightly lower than a high idle engine speed whereas the second specified engine speed is set to a value equal to a low idle engine speed.

* * * * *